US011193710B2

(12) United States Patent
Goloubev

(10) Patent No.: US 11,193,710 B2
(45) Date of Patent: Dec. 7, 2021

(54) METHOD AND APPARATUS FOR THE CRYOGENIC SEPARATION OF AIR

(71) Applicant: LINDE AKTIENGESELLSCHAFT, Munich (DE)

(72) Inventor: Dimitri Goloubev, Munich (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 823 days.

(21) Appl. No.: 14/788,871

(22) Filed: Jul. 1, 2015

(65) Prior Publication Data

US 2016/0003534 A1 Jan. 7, 2016

(30) Foreign Application Priority Data

Jul. 5, 2014 (EP) ..... 14002309

(51) Int. Cl.
*F25J 3/04* (2006.01)

(52) U.S. Cl.
CPC ..... *F25J 3/04078* (2013.01); *F25J 3/0409* (2013.01); *F25J 3/04018* (2013.01); *F25J 3/04024* (2013.01); *F25J 3/04054* (2013.01); *F25J 3/04084* (2013.01); *F25J 3/04145* (2013.01); *F25J 3/04175* (2013.01); *F25J 3/04296* (2013.01); *F25J 3/04393* (2013.01); *F25J 3/04412* (2013.01); *F25J 3/04678* (2013.01); *F25J 3/04727* (2013.01); *F25J 3/04812* (2013.01); *F25J 2205/04* (2013.01); *F25J 2240/04* (2013.01); *F25J 2240/42* (2013.01); *F25J 2245/50* (2013.01)

(58) Field of Classification Search
CPC ..... F25J 3/04472–04515
See application file for complete search history.

(56) References Cited

U.S. PATENT DOCUMENTS 6,185,960 B1 * 2/2001 Volt ..... F25J 3/04018 62/656
2005/0126221 A1 6/2005 Ha et al.
(Continued)

FOREIGN PATENT DOCUMENTS

CA 2695817 A1 * 2/2009 ..... F25J 3/04187
DE 10339230 A1 3/2005
(Continued)

*Primary Examiner* — John F Pettitt, III
(74) *Attorney, Agent, or Firm* — Millen White Zelano & Branigan, PC

(57) ABSTRACT

A method and the apparatus for the cryogenic separation of air in an air separation plant which has a main air compressor, a main heat exchanger and a distillation column system with a high-pressure column and a low-pressure column. All of the feed air is compressed in the main air compressor to a first air pressure which is at least 3 bar higher than the operating pressure of the high-pressure column. A first part of the compressed total air flow, as first air flow at the first air pressure, is cooled and liquefied or pseudo-liquefied in the main heat exchanger, then expanded and introduced into the distillation column system. A second part of the compressed total air flow, as second air flow, is post-compressed in an air post-compressor to a second air pressure and at least part is further compressed in a first turbine-driven post-compressor to a third air pressure.

15 Claims, 9 Drawing Sheets

(56) References Cited

U.S. PATENT DOCUMENTS

| | | | | |
|---|---|---|---|---|
| 2006/0010912 | A1 | 1/2006 | Brugerolle et al. | |
| 2006/0277944 | A1 * | 12/2006 | Le Bot | F25J 3/0409 62/646 |
| 2009/0064714 | A1 * | 3/2009 | Rottmann | F25J 3/04054 62/642 |

FOREIGN PATENT DOCUMENTS

| | | | | |
|---|---|---|---|---|
| DE | 102007014643 | A1 | 9/2007 | |
| EP | 2520886 | A1 | 7/2012 | |
| WO | WO 2012019753 | A2 | 2/2012 | |
| WO | WO-2013075867 | A1 * | 5/2013 | F25J 3/04054 |

* cited by examiner

METHOD AND APPARATUS FOR THE CRYOGENIC SEPARATION OF AIR

CROSS REFERENCE TO RELATED APPLICATIONS

This application claims priority from European Patent Application EP 14002309.4 filed Jul. 5, 2014.

BACKGROUND OF THE INVENTION

The invention relates to a method for the cryogenic separation of air in an air separation plant which has a main air compressor, a main heat exchanger and a distillation column system with a high-pressure column and a low-pressure column. Such a method is known from U.S. Pat. No. 7,437,890.

According to the invention, the "air post-compressor" and the turbine-driven post-compressor are connected in series; the post-compressor can be arranged upstream or downstream of the air post-compressor.

A "main air compressor" is in this context understood as a multi-stage machine whose stages have a common drive (electric motor, steam turbine or gas turbine) and are arranged in a common housing. It can for example be formed by a geared compressor in which the stages are grouped around the gearing casing. This gearing has a large gear which drives multiple parallel pinion shafts with respectively one or two stages.

The "air post-compressor" can be formed by a multi-stage machine which is separate from the main air compressor; alternatively the main air compressor and the air post-compressor are formed by a single multi-stage machine whose stages have a common drive and are arranged in a common housing. The first stages of this machine then form the main air compressor and the last stage(s) form the air post-compressor.

Methods and apparatuses for the cryogenic separation of air are for example known from Hausen/Linde, Tieftemperaturtechnik [Cryogenics], 2$^{nd}$ Edition 1985, Chapter 4 (pages 281 to 337).

The distillation column system of the invention can be designed as a one-column-system, as a two-column-system (for example as a classic Linde twin-column system), or also as a three- or multi-column-system. In addition to the columns for nitrogen-oxygen-separation, it can have further apparatuses for obtaining high-purity products and/or other air components, in particular noble gases, for example argon production and/or krypton-xenon production.

In the process, a liquid pressurized first product flow is evaporated in the main heat exchanger and then obtained as a pressurized gaseous product. This method is also termed internal compression. In the case of a supercritical pressure, no phase change per se takes place; the product flow is then "pseudo-evaporated".

Counter to the (pseudo-)evaporating product flow, a heat transfer medium at high pressure is liquefied (or, respectively, pseudo-liquefied if it is at a supercritical pressure). The heat transfer medium frequently consists of one part of the air, in the present case in particular of the first partial flow and the second (and, where appropriate, the third) part of the second partial flow of the feed air.

Internal compression methods are for example known from DE 830805, DE 901542 (=U.S. Pat. No. 2,712,738/U.S. Pat. No. 2,784,572), DE 952908, DE 1103363 (=U.S. Pat. No. 3,083,544), DE 1112997 (=U.S. Pat. No. 3,214,925), DE 1124529, DE 1117616 (=U.S. Pat. No. 3,280,574), DE 1226616 (=U.S. Pat. No. 3,216,206), DE 1229561 (=U.S. Pat. No. 3,222,878), DE 1199293, DE 1187248 (=U.S. Pat. No. 3,371,496), DE 1235347, DE 1258882 (=U.S. Pat. No. 3,426,543), DE 1263037 (=U.S. Pat. No. 3,401,531), DE 1501722 (=U.S. Pat. No. 3,416,323), DE 1501723 (=U.S. Pat. No. 3,500,651), DE 253132 (=U.S. Pat. No. 4,279,631), DE 2646690, EP 93448 B1 (=U.S. Pat. No. 4,555,256), EP 384483 B1 (=U.S. Pat. No. 5,036,672), EP 505812 B1 (=U.S. Pat. No. 5,263,328), EP 716280 B1 (=U.S. Pat. No. 5,644,934), EP 842385 B1 (=U.S. Pat. No. 5,953,937), EP 758733 B1 (=U.S. Pat. No. 5,845,517), EP 895045 B1 (=U.S. Pat. No. 6,038,885), DE 19803437 A1, EP 949471 B1 (=U.S. Pat. No. 6,185,960 B), EP 955509 A1 (=U.S. Pat. No. 6,196,022 B1), EP 1031804 A1 (=U.S. Pat. No. 6,314,755), DE 19909744 A1, EP 1067345 A1 (=U.S. Pat. No. 6,336,345), EP 1074805 A1 (=U.S. Pat. No. 6,332,337), DE 19954593 A1, EP 1134525 A1 (=U.S. Pat. No. 6,477,860), DE 10013073 A1, EP 1139046 A1, EP 1146301 A1, EP 1150082 A1, EP 1213552 A1, DE 10115258 A1, EP 1284404 A1 (=US 2003051504 A1), EP 1308680 A1 (=U.S. Pat. No. 6,612,129 B2), DE 10213212 A1, DE 10213211 A1, EP 1357342 A1 or DE 10238282 A1, DE 10302389 A1, DE 10334559 A1, DE 10334560 A1, DE 10332863 A1, EP 1544559 A1, EP 1585926 A1, DE 102005029274 A1, EP 1666824 A1, EP 1672301 A1, DE 102005028012 A1, WO 2007033838 A1, WO 2007104449 A1, EP 1845324 A1, DE 102006032731 A1, EP 1892490 A1, DE 102007014643 A1, EP 2015012 A2, EP 2015013 A2, EP 2026024 A1, WO 2009095188 A2 or DE 102008016355 A1.

This application describes multiple process parameters such as mass flow rates or pressures, which are "smaller" or "greater" in one mode of operation than in another mode of operation. This refers in this case to targeted changes to the respective parameter by means of regulating and/or setting devices and not to natural variations within a stationary operating state. These targeted changes can be brought about either directly by controlling the parameter itself or indirectly by controlling other parameters which influence the parameter to be changed. In particular, a parameter is then "greater" or, respectively, "smaller" if the difference between the average values of the parameter in the various modes of operation is greater than 2%, in particular greater than 5%, in particular greater than 10%.

In the case of the pressure values, in this case the natural pressure losses are generally not taken into account. Pressures are considered "equal" here if the pressure differences between the corresponding locations are not greater than the natural pipe losses which are caused by pressure losses in pipes, heat exchangers, coolers, adsorbers etc. For example, if the first product flow experiences a pressure loss in the passages of the main heat exchanger, the output pressure of the compressed gas product downstream of the main heat exchanger and the pressure upstream of the main heat exchanger are nonetheless equally termed "the first product pressure" here. Conversely, the second pressure of a flow downstream of certain method steps is then "lower" or "higher" than the first pressure upstream of these steps only if the corresponding pressure differences are higher than the natural pipe losses, that is to say in particular the pressure rise takes place by means of at least one compressor stage or, respectively, the pressure reduction takes place in a targeted manner by means of at least one throttle valve and/or at least one expansion machine (expansion turbine).

The "main heat exchanger" serves for cooling feed air in indirect heat exchange with back flow from the distillation column system. It can be formed of a single or a plurality of parallel- and/or series-connected heat exchanger sections, for example of one or more plate heat exchanger blocks.

SUMMARY OF THE INVENTION

The invention is based on the object of indicating a method of the type mentioned in the introduction and an apparatus which can be operated with a highly variable liquid product fraction. In that context, the "liquid product fraction" includes only flows which leave the air separation plant in liquid form and for example are introduced into a liquid tank, but not internally compressed flows which, although they are removed from the distillation column system in liquid form, are however evaporated or pseudo-evaporated within the air separation plant and are then discharged from the air separation plant in the gaseous state.

This object is achieved by a method for the cryogenic separation of air in an air separation plant which has a main air compressor, a main heat exchanger (8) and a distillation column system with a high-pressure column (10) and a low-pressure column, wherein all of the feed air (1) is compressed in the main air compressor (3*a*) to a first air pressure which is at least 3 bar higher than the operating pressure of the high-pressure column, in order to form a compressed total air flow (4, 7), a first part of the compressed total air flow, as first air flow (100) at the first air pressure, is cooled and liquefied or pseudo-liquefied in the main heat exchanger (8), then expanded (101) and introduced (102, 9) into the distillation column system, a second part of the compressed total air flow, as second air flow (200), is post-compressed in an air post-compressor (3*b*) to a second air pressure which is higher than the first air pressure, and at least a first part of the second air flow is further compressed in a post-compression system to a third air pressure which is higher than the second air pressure, wherein the post-compression system has at least one first turbine-driven post-compressor (202*c*), a first partial flow of the second air flow as third air flow (210) at a first turbine inlet pressure is introduced into a first turbine (202*t*), where it is expanded, performing work, and is then introduced (211, 213, 22) into the distillation column system, wherein the first turbine inlet pressure is greater than the first air pressure but is not greater than the third air pressure, and the first turbine (202*t*) drives the first turbine-driven post-compressor (202*c*), a second partial flow of the second air flow as fourth air flow (220), at a pressure which is greater than the first air pressure but not greater than the third air pressure, is cooled and liquefied or pseudo-liquefied in the main heat exchanger (8), then expanded (221) and introduced (222) into the distillation column system, at least occasionally at least one liquid product (30; 39; LAR) is obtained in the distillation column system and is drawn off from the air separation plant, a first product flow (37; 43) is drawn off in liquid form from the distillation column system, is raised in the liquid state to a first elevated product pressure (41; 44), is evaporated or pseudo-evaporated and heated in the main heat exchanger (8) and the heated first product flow (42; 45) is drawn off from the air separation plant as first compressed gas product, characterized in that at least occasionally a third partial flow of the second air flow as sixth air flow (230) in the main heat exchanger (8) is cooled to a first intermediate temperature, is further compressed in a cold compressor (14*c*) to a fourth air pressure which is higher than the third air pressure and the further compressed sixth air flow (231) at the fourth air pressure is cooled and liquefied or pseudo-liquefied in the main heat exchanger (8), then expanded (233) and introduced (234, 9) into the distillation column system, in a first mode of operation a first total quantity of liquid products (30; 39; LAR) is drawn off from the air separation plant, in a second mode of operation a second total quantity of liquid products (30; 39; LAR), which is less than the first total quantity, is drawn off from the air separation plant, and in that in the first mode of operation the quantity of air which is guided as sixth air flow (230) through the cold compressor (14*c*) is less than in the second mode of operation.

The "first mode of operation" of the invention is configured for a particularly high liquid production, in particular for maximum liquid production (total quantity of liquid products which is drawn off from the air separation plant). The "second mode of operation" is, by contrast, configured for a lower liquid product fraction, which can for example also be zero (pure gas operation). In the second mode of operation, the total quantity of liquid products is for example 0%, or somewhat higher, for example between 15% and 50%. (All percentages relate here and in the following to the molar quantity, unless stated otherwise. The molar quantity can for example be indicated in $Nm^3/h$.)

The method according to the invention uses a cold compressor which is either operated only in the second mode of operation (and can thus be switched off) and is not operated in the first mode of operation—or is operated in the first mode of operation with a lower load than in the second. At first glance, it does not appear to be productive to operate fewer turbines during operation with maximum liquid production, since turbines can fundamentally be used for producing the cold for the product liquefaction. Within the context of the invention, it has however been found that this measure makes it possible to achieve a particularly high variation in the liquid product quantity, with satisfactory efficiency being achieved in both modes of operation, thus overall comparably low energy consumption.

A"cold compressor" is in this context understood as a compression device, in which the gas for the compression is supplied at a temperature which is far below ambient temperature, generally below 250 K, preferably below 200 K.

In the method according to the invention, the cold compressor can be driven by an electric motor. In many cases, however, it is expedient to use a turbine-cold compressor combination, at least occasionally a third part of the compressed total air flow as fifth air flow (301) at the first air pressure is introduced into a second turbine (14*t*) where it is expanded, performing work, the second turbine (14*t*) drives a second turbine-driven post-compressor which is formed by the cold compressor (14*c*), the fifth air flow (302), which has been expanded, performing work, is introduced (13) into the distillation column system and in that in the first mode of operation the quantity of air which is guided as fifth air flow (14*t*) through the second turbine is less than in the second mode of operation. The quantity of air which passes as fifth air flow through the second turbine, which drives the cold compressor, is smaller in the first mode of operation than in the second mode of operation. In an extreme example, the turbine-cold compressor combination in the first mode of operation is entirely non-operational, such that the corresponding quantity of air is equal to zero.

The inlet pressure of the second turbine can be approximately equal to the inlet pressure of the first turbine; however, the two inlet pressures are preferably different. In particular, the inlet pressure of the second turbine can be lower than that of the first turbine and can for example be around the first air pressure or the second air pressure.

It is expedient if in the second mode of operation only a relatively small part of the feed air is compressed to the third, higher air pressure—in the first mode of operation a first quantity of air of the compressed total air flow forms the first air flow (100) and a second quantity of air of the compressed total air flow forms the second air flow (200) and in the second mode of operation a third quantity of air of the compressed total air flow, which is greater than the first quantity of air, forms the first air flow (100) and a fourth quantity of air of the compressed total air flow, which is less than the second quantity of air, forms the second air flow (200).

The third air pressure can moreover be lower than in the first mode of operation.

Preferably, the third air flow is introduced into the first turbine at the second air pressure.

In a particularly preferred embodiment, the third air flow is expanded in the first turbine to an outlet pressure which is equal to the operating pressure of the high-pressure column (plus pipe losses).

The outlet pressure of the second turbine can also be equal to the operating pressure of the high-pressure column (plus pipe losses) or can also be below it, for example at the operating pressure of the low-pressure column (plus pipe losses), such that in that the fourth air flow (220) is expanded in the first turbine (202*t*) to an outlet pressure which is equal to the operating pressure of the high-pressure column (10).

Further the fifth air flow (301) is expanded in the second turbine (14*t*) to an outlet pressure which is equal to the operating pressure of the high-pressure column (10). The third partial flow is then for example introduced into the low-pressure column.

Otherwise, the expanded partial flows can be introduced in part or in full into the high-pressure column, in that in both modes of operation at least one part of at least one of the following air flows is respectively introduced into the high-pressure column (10) downstream of the expansion of said air flow:

first air flow (102), —third air flow (211), —fourth air flow (220), and in that at least one part of the expanded fifth air flow (302) is introduced (13) into the high-pressure column (10).

Fundamentally, the air post-compressor can be formed by one or more compressor stages which are independent from the main air compressor. According to one special configuration of the invention, however, the air post-compressor is formed by a second set of stages of a combined machine, whose first set of stages form the main air compressor. The main air compressor is generally formed by two or more stages, the air post-compressor by one or two stages, for example by the last stage or stages of the combined machine.

Preferably, in the second mode of operation, the quantity of the fourth air flow guided to the cold end of the main heat exchanger is smaller than in the first mode of operation.

Additionally, the plant can have a third turbine which is operated only in the second mode of operation in that the fourth air flow (220) in the second mode of operation comprises a smaller quantity than in the first mode of operation or in the first mode of operation with a lower throughput than in the second.

This turbine preferably drives a third post-compressor which is connected in series to the second set of air compressor stages and to the first turbine-driven post-compressor, wherein again the sequence is unimportant. The second post-compressor can, in the second mode of operation, be bypassed by a bypass line.

In the first mode of operation the third turbine (50*t*) drives a third turbine-driven post-compressor (50*c*) which is part of the post-compression system. It is possible in the method for more than one internal compression product to be generated, and also more than two internal compression products. The various internal compression products can differ in terms of their chemical composition (for example oxygen/nitrogen or also oxygen or nitrogen of various purities) or in terms of their pressure, or both.

The invention further relates to an air separation plant in the form of an apparatus for the cryogenic separation of air with a main heat exchanger (8), a distillation column system having a high-pressure column (10) and a low-pressure column, a main air compressor (3*a*) for compressing all of the feed air (1) to a first air pressure which is at least 3 bar higher than the operating pressure of the high-pressure column, in order to form a compressed total air flow (4, 7), means for cooling a first part of the compressed total air flow as first air flow (100) at the first air pressure in the main heat exchanger (8), means for expanding (101) the cooled first air flow and for introducing (102, 9) this air flow into the distillation column system, an air post-compressor (3*b*) for post-compressing a second part of the compressed total air flow as second air flow (200) to a second air pressure, a post-compression system for further compressing at least a first part of the second partial flow to a third air pressure which is higher than the second air pressure, wherein the post-compression system has at least one first turbine-driven post-compressor (202*c*), a first turbine (202*t*) for the work-performing expansion of a first partial flow of the second air flow as third air flow (210), from a first turbine inlet pressure which is greater than the first air pressure but not greater than the third air pressure, wherein the first turbine (202*t*) is coupled to the first turbine-driven post-compressor (202*c*), means for cooling a second partial flow of the second air flow as fourth air flow (220) at a pressure which is greater than the first air pressure but not greater than the third air pressure, in the main heat exchanger (8), means for expanding (221) the cooled fourth air flow and for introducing (222) this air flow into the distillation column system, means for obtaining at least one liquid product (30; 39; LAR) in the distillation column system and means for drawing it off from the air separation plant, means for drawing off, in liquid form, a first product flow (37; 43) from the distillation column system, for increasing pressure in the liquid state to a first elevated product pressure (41; 44), for heating in the main heat exchanger (8) and with means for drawing off the heated first product flow (42; 45) as first compressed gas product from the air separation plant, characterized by means for cooling a third partial flow of the second air flow as sixth air flow (230) in the main heat exchanger (8) to a first intermediate temperature, a cold compressor (14*c*) for further compressing the sixth air flow to a fourth air pressure which is higher than the third air pressure, means for cooling the further compressed sixth air flow at the fourth air pressure in the main heat exchanger (8), means for expanding (233) the cooled sixth air flow and for introducing (234, 9) this air flow into the distillation column system, and with means for switching between a first and a second mode of operation, wherein in a first mode of operation a first total quantity of liquid products (30; 39; LAR) is drawn off from the air separation plant, in a second mode of operation a second total quantity of liquid products (30; 39; LAR) is drawn off from the air separation plant, which is less than the first total quantity, and in the first mode of operation the quantity of air which as sixth air flow (230) is guided through the cold compressor (14*c*) is less than in the second mode of operation.

The apparatus according to the invention can be complemented by apparatus features which correspond to the features of the dependent method claims and the description provided herein.

The "means for switching between a first and a second mode of operation" are complex regulating and control devices which, by cooperating, permit at least partially automatic switching between both modes of operation, and are for example an appropriately programmed operating control system.

BRIEF DESCRIPTION OF THE DRAWINGS

The invention, and further details of the invention, are explained in more detail below with reference to exemplary embodiments represented schematically in the drawings, in which:

FIGS. 1A and 1B show two variants of FIG. 1;

DETAILED DESCRIPTION OF THE INVENTION

Figure 1:
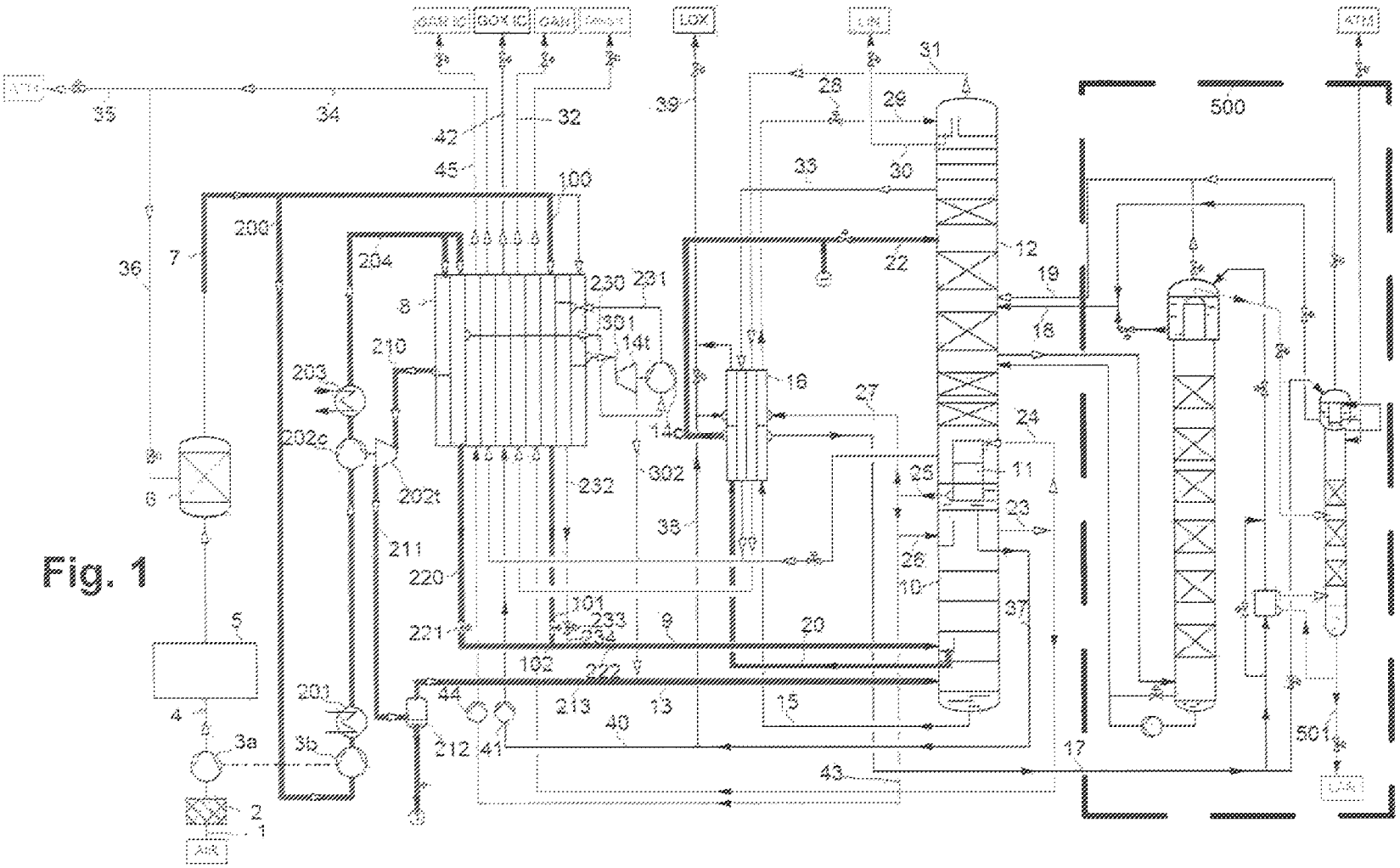
FIG. 1 shows a first exemplary embodiment of a system according to the invention with two turbines.

The first exemplary embodiment of the invention is first explained below with reference to the first mode of operation, which in this case is configured for maximum liquid production. In this context, air flows only through the lines represented in bold in FIG. 1; in the first mode of operation, the remaining air lines are not flowed through. Atmospheric air 1 (AIR) is drawn in, via a filter 2, by a first set 3*a* of a main air compressor 3*a* and is compressed to a first air pressure of preferably 10 bar to 14 bar, for example 11.7 bar. In the concrete example, the main air compressor has four compressor stages. Downstream of the main air compressor 3*a*, the compressed total air 4 at the first air pressure is treated in a pre-cooling device 5 and then in a purification device 6. The purified total air 7 is split into a first air flow 100 and a second air flow 200.

The first air flow 100 is cooled in a main heat exchanger 8, from the hot to the cold end, and in that context is (pseudo-)liquefied and then expanded in a throttle valve 101 to approximately the operating pressure of the high-pressure column explained below, which is preferably 5 bar to 7 bar, for example 6 bar. The expanded first air flow 102 is fed, via the line 9, to the distillation column system which has a high-pressure column 10, a main condenser 11, which is designed as a condenser-evaporator, and a low-pressure column 12.

The second air flow 200 is post-compressed in an air post-compressor 3*b*, which in this case is formed by the end stage 3*b* of a combined machine 3*a*/3*b*, and in a first turbine-driven post-compressor 202*c* to a second air pressure of preferably 20 bar to 25 bar, for example 21.8 bar. The post-compressed second air flow 204 is split into a first and a second part, a third air flow 210 and a fourth air flow 220.

The third air flow 210 is fed to the hot end of the main heat exchanger 8 and is removed again at a first intermediate temperature. The third air flow is fed, at this intermediate temperature and the second air pressure, to a first turbine 202*t* where it is expanded, performing work, to the operating pressure of the high-pressure column 10, which is 5 bar to 7 bar, for example 6 bar. The first turbine 202*t* is mechanically coupled to the first post-compressor 202*c*. The third air flow 211 which has been expanded so as to perform work is introduced into a separator (phase separator) 212 where a small liquid fraction is removed therefrom. It then flows, in purely gaseous form, via the lines 213 and 13 to the sump of the high-pressure column 10. The turbine inlet pressure is in this case equal to the second air pressure.

The fourth air flow 220 is also guided to the hot end of the main heat exchanger 8, but flows through the latter to the cold end and is thereby cooled and (pseudo-)liquefied. It is then expanded in a throttle valve and arrives, via the lines 222 and 9, in the high-pressure column 10.

The air separation plant represented in FIG. 1 also has a second turbine 14*t* which is coupled to a cold compressor 14*c*; in the exemplary embodiment, this machine is non-operational in the first mode of operation.

In the distillation column system, the sump liquid 15 of the high-pressure column is cooled in a countercurrent subcooler 16 and is fed via line 17 to an argon part 500 which will be explained later. Thence, it flows in part in liquid form (line 18) and in part in gaseous form (line 19) at the low-pressure column pressure back out and is introduced at a suitable point into the low-pressure column 12. (If no argon part is present, the subcooled sump liquid is immediately expanded to low-pressure column pressure and introduced into the low-pressure column.)

At least part of the liquid air guided via line 9 into the high-pressure column 10 is removed again via line 18, also cooled in the countercurrent subcooler 16 and is fed to the low-pressure column 12 via valve 21 and line 22.

A first part 24 of the gaseous overhead nitrogen 23 of the high-pressure column 10 is introduced into the liquefaction space of the main condenser 11 where it is essentially entirely liquefied. A first part 26 of the liquid nitrogen 25 so obtained is given up to the high-pressure column 10 as recirculation. A second part 27 is cooled in the countercurrent subcooler 16 and is fed via valve 28 and line 29 to the top of the low-pressure column 12. In the first mode of operation, part of this is removed again via line 30 and is obtained as liquid nitrogen product (LIN) and is drawn off from the air separation plant.

From the top of the low-pressure column, in which there prevails a pressure of 1.2 bar to 1.6 bar, for example 1.3 bar, gaseous low-pressure nitrogen 31 is removed, is heated in the countercurrent subcooler 16 and in the main heat exchanger 8 and is drawn off via line 32 as gaseous low-pressure product (GAN). Gaseous impure nitrogen 33 from the low-pressure column is also heated in the countercurrent subcooler 16 and the main heat exchanger 8. The hot impure nitrogen 34 can either be vented into the atmosphere (ATM) via line 35 or can be used, via line 36, as regeneration gas in the purification device 6.

Liquid oxygen is drawn off, via line 37, from the sump of the low-pressure column 12 (specifically from the evaporation space of the main condenser 11). As the case may be, a first part 38 is subcooled in the countercurrent subcooler 16 and is obtained via line 39 as liquid oxygen product (LOX) and is drawn off from the air separation plant. A second part 40 forms the "first product flow", is raised in a pump 41 to a first product pressure of for example 31 bar is evaporated or pseudo-evaporated at this high pressure in the main heat exchanger 16 and is heated to near ambient temperature. The hot high-pressure oxygen 42 is given off as oxygen-rich first compressed gas product (GOX IC).

A further internal compression product can be obtained from a third part 43 of the liquid nitrogen 25 from the main condenser 11. This is raised as "second product flow" in a pump 44 in liquid form to a second product pressure of for example 12 bar. At this second product pressure, it is evaporated in the main heat exchanger 8 and heated to near ambient temperature. The hot high-pressure nitrogen 45 is then given off at the second product pressure as nitrogen-rich compressed gas product (GAN IC).

If an argon product is required, the air separation plant also has an argon part 500 which functions as described in EP 2447563 A1 and produces a further liquid product in the form of pure liquid argon (LAR) which is drawn off via line 501.

The "first total quantity of liquid products", which is drawn off from the air separation plant in the first mode of operation, consists in this exemplary embodiment of the flows 30 (LIN), 39 (LOX) and 501 (LAR).

In a second mode of operation, the plant is operated with a reduced "second total quantity of liquid products". In general, the flow quantity is reduced in at least one of the lines 30 and 39, preferably in both. The operation of the argon part is preferably kept constant, such that the LAR quantity also remains equal. The quantities and pressures of the internal compression products 42, 45 also remain constant.

The total quantity of air is reduced, such that already the first stages 3*a* of the main air compressor 3*a*/3*b* use less energy. In addition, the quantity and pressure of the second partial flow 204 are greatly reduced, such that the end stage 3*b* of the main air compressor 3*a*/3*b* is also under less load. The quantity of air in line 220 which is thus lacking for the internal compression is compensated for by the fact that a third part 230 of the second air flow 204 is raised in the cold compressor 14*c* to a third, even higher pressure of for example 45 bar and flows through the main heat exchanger as far as the cold end at this very high pressure. The cold pseudo-liquefied third part 232 is expanded in a throttle valve 233 to the high-pressure column pressure and is fed via the lines 234 and 9 to the high-pressure column 10.

The cold compressor 14*c* is driven by the second expansion turbine 14*t*, in which a third partial flow 301 of the compressed total air flow 7, as "fifth air flow", is expanded so as to perform work from the first air pressure to the operating pressure of the high-pressure column 10.

The table below shows, in a concrete numerical example, a comparison between the first and second modes of operation, wherein in this case the second mode of operation is configured as pure gas operation (excluding argon).

| Product | Constant product parameters | First mode of operation | Second mode of operation |
|---|---|---|---|
| GOX IC | 31 bar and 99.8 mol-% | 18000 Nm3/h | 18000 Nm3/h |
| LOX | 99.8 mol-% | 2000 Nm3/h | 0 |
| GAN IC | 1 ppm O2 | 7000 Nm3/h | 7000 Nm3/h |
| LIN | 1 ppm O2 | 2000 Nm3/h | 0 |
| LAR | 1 ppm O2 | maximum | maximum |
| N2 | 1 ppm O2 | maximum | maximum |

Figure 1A:
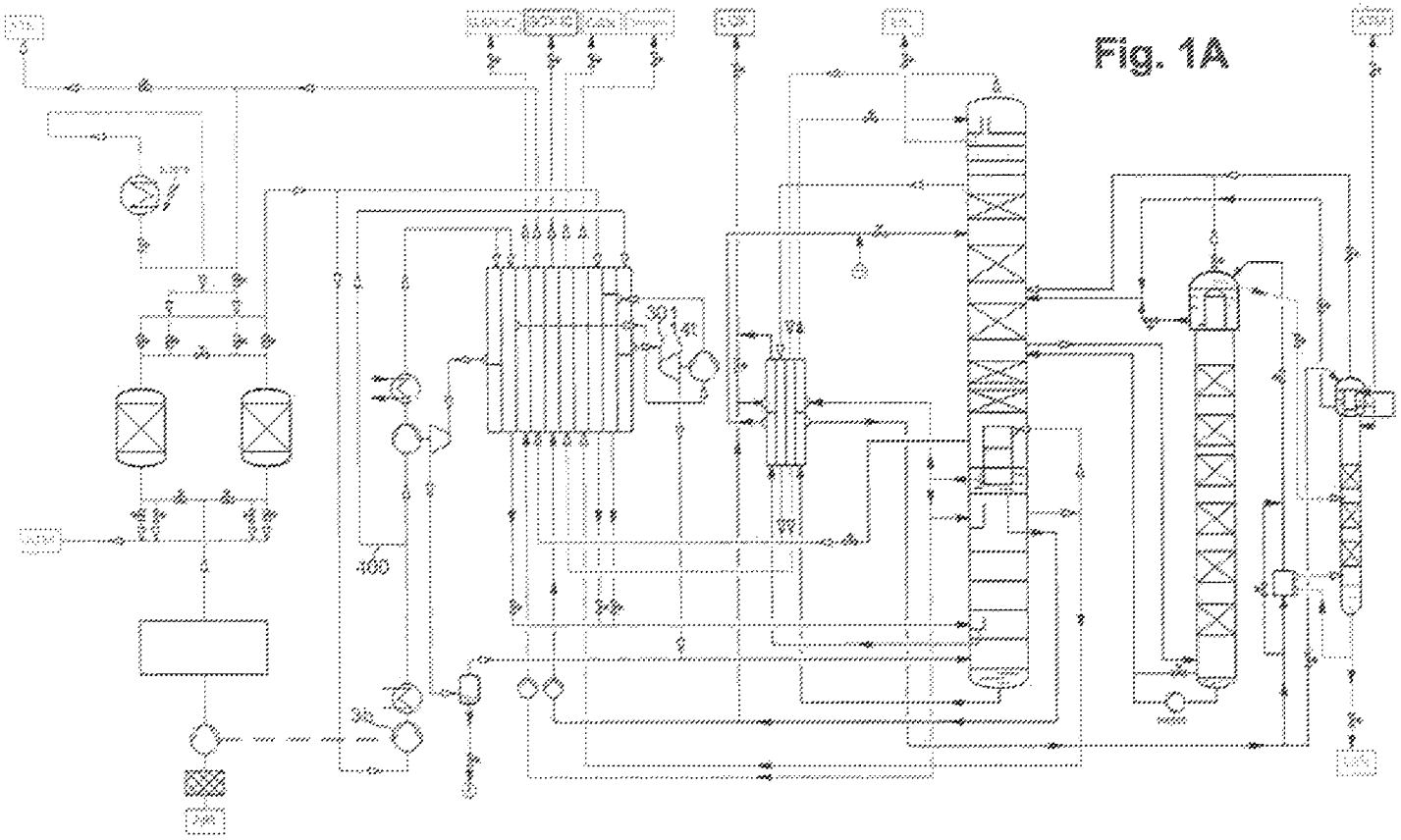
Figure 18:
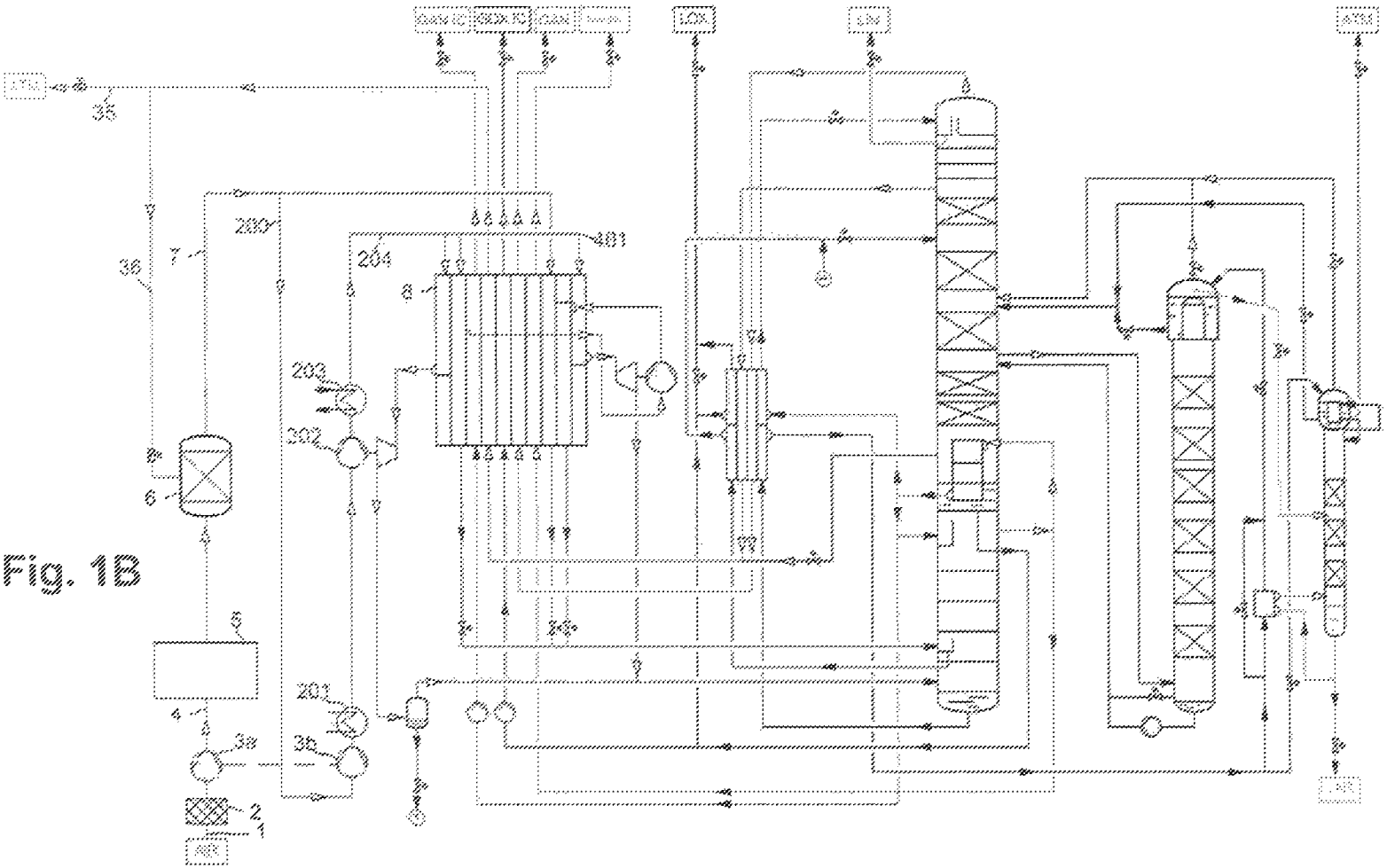

FIG. 1A differs from FIG. 1 in that the fifth air flow 301 to the second turbine 14*t* is not at the first air pressure but at the second air pressure downstream of the air post-compressor 3*b*. The additional power 400 feeds it from the outlet of the air post-compressor 3*b* to the hot end of the main heat exchanger and further via line 301 to the turbine inlet.

In FIG. 1B, a still higher inlet pressure prevails at the turbine 14*t*, in that the fifth air flow 401/301 is at the third air pressure downstream of the hot post-compressor 202.

Figure 2:
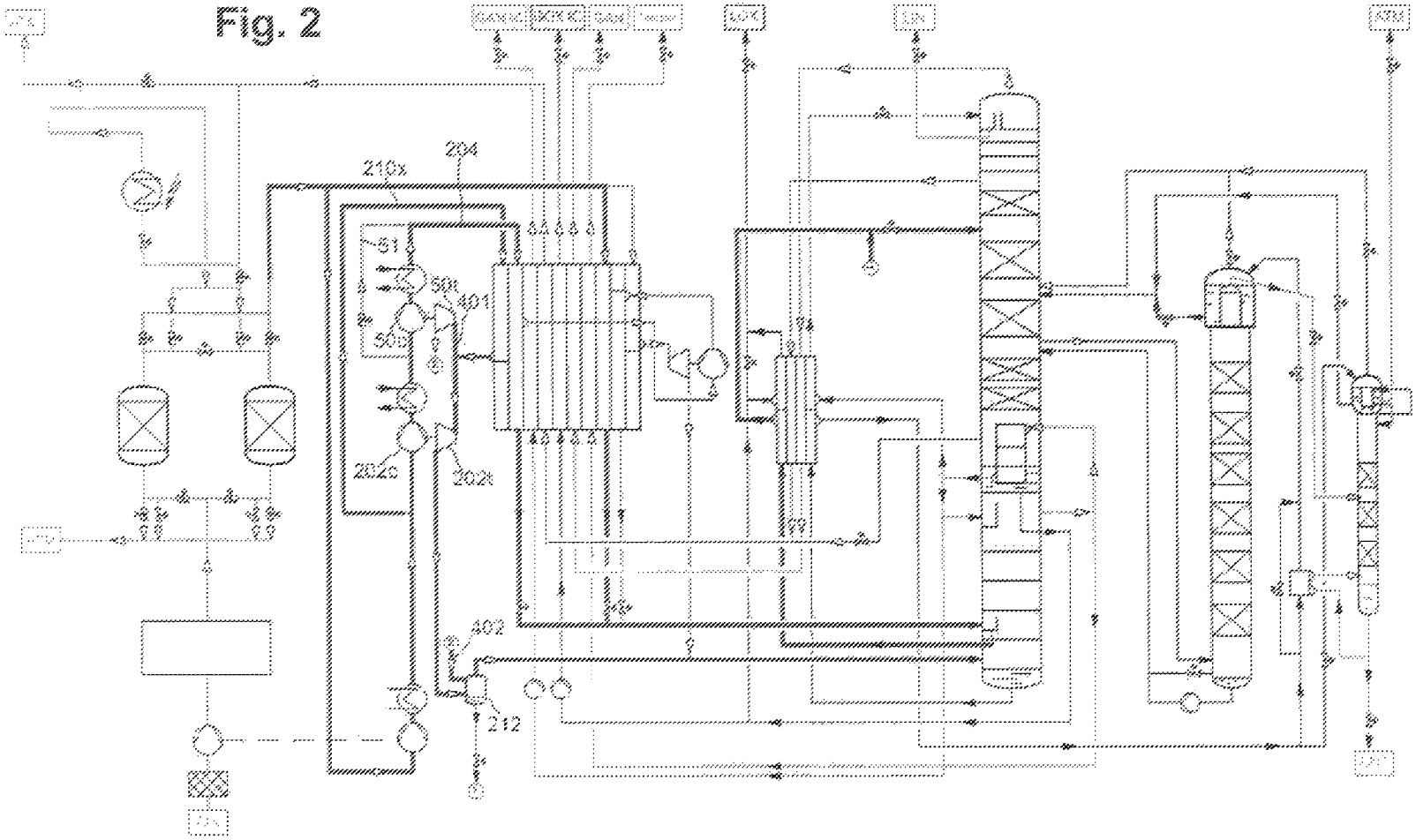
FIG. 2 shows a second exemplary embodiment with three turbines.

FIG. 2 differs from FIG. 1 by a further turbine-compressor combination 50*t*/50*c* which is flowed through only in the first mode of operation. A third turbine 50*t* then drives a third turbine-driven post-compressor 50*c*. In the third turbine, a seventh air flow 401, which is formed by a fourth part 401 of the second air flow 204, is expanded so as to perform work. The third turbine 50*t* is operated with the same inlet and outlet pressures as the first turbine 202*t*. The expanded seventh air flow 402 is introduced into the separator 212. In the first mode of operation, the post-compressor 50*c* runs and generates the "third air pressure" in line 204. The two post-compressors 202*c* and 50*c* form, in the exemplary embodiment, the "post-compression system".

In the second mode of operation, the seventh air flow is reduced to zero, and the second air flow flows via a bypass line 51 past the second post-compressor 50*c*. In this mode of operation, the post-compressor 202*c* generates the "third air pressure" in lines 51 and 204. The third air pressure is lower in the second mode of operation than in the first mode of operation.

In all exemplary embodiments, an aftercooler is located downstream of each compressor stage for removing the compression heat.

A further difference with respect to FIG. 1 consists, in the embodiment of FIG. 2, in that the turbine inlet pressure at the first turbine 202*t* (as also at the third 50*t*) is lower than the second air pressure, because the turbine air (the third and also the seventh air flow) is branched off (line 210*x*) upstream of the first turbine-driven post-compressor 202*c*. Such a reduced turbine inlet pressure (which permits a raised level of the second air pressure) can also be used in analogous fashion in FIG. 1.

Of course, in FIGS. 1 and 2, intermediate forms between the first mode of operation and pure gas operation, in which LOX and/or LIN are produced in reduced quantity greater than zero, are also possible; these are then also considered "second mode of operation" within the meaning of the claims. However, in these exemplary embodiments the turbine-cold compressor combination is switched off in the first mode of operation. It is brought into operation only in the second mode of operation.

Figure 2A:
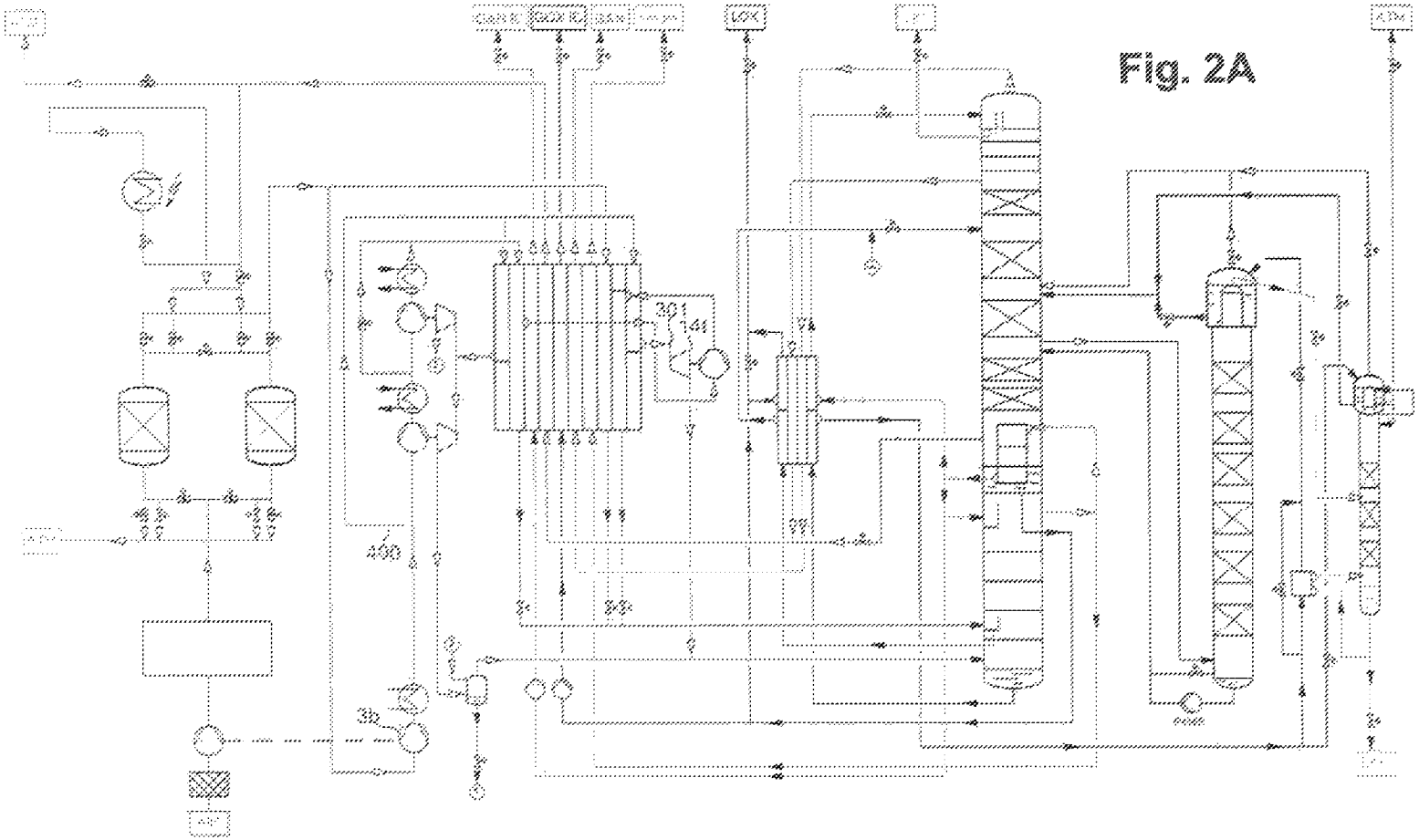
FIGS. 2A and 2B show two variants of FIG. 2.

FIG. 2A differs from FIG. 2 in that the fifth air flow 301 to the second turbine 14*t* is not at the first air pressure, rather at the second air pressure downstream of the air post-compressor 3*b*. The additional power 400 feeds it from the outlet of the air post-compressor 3*b* to the hot end of the main heat exchanger and further via line 301 to the turbine inlet.

Figure 2B:
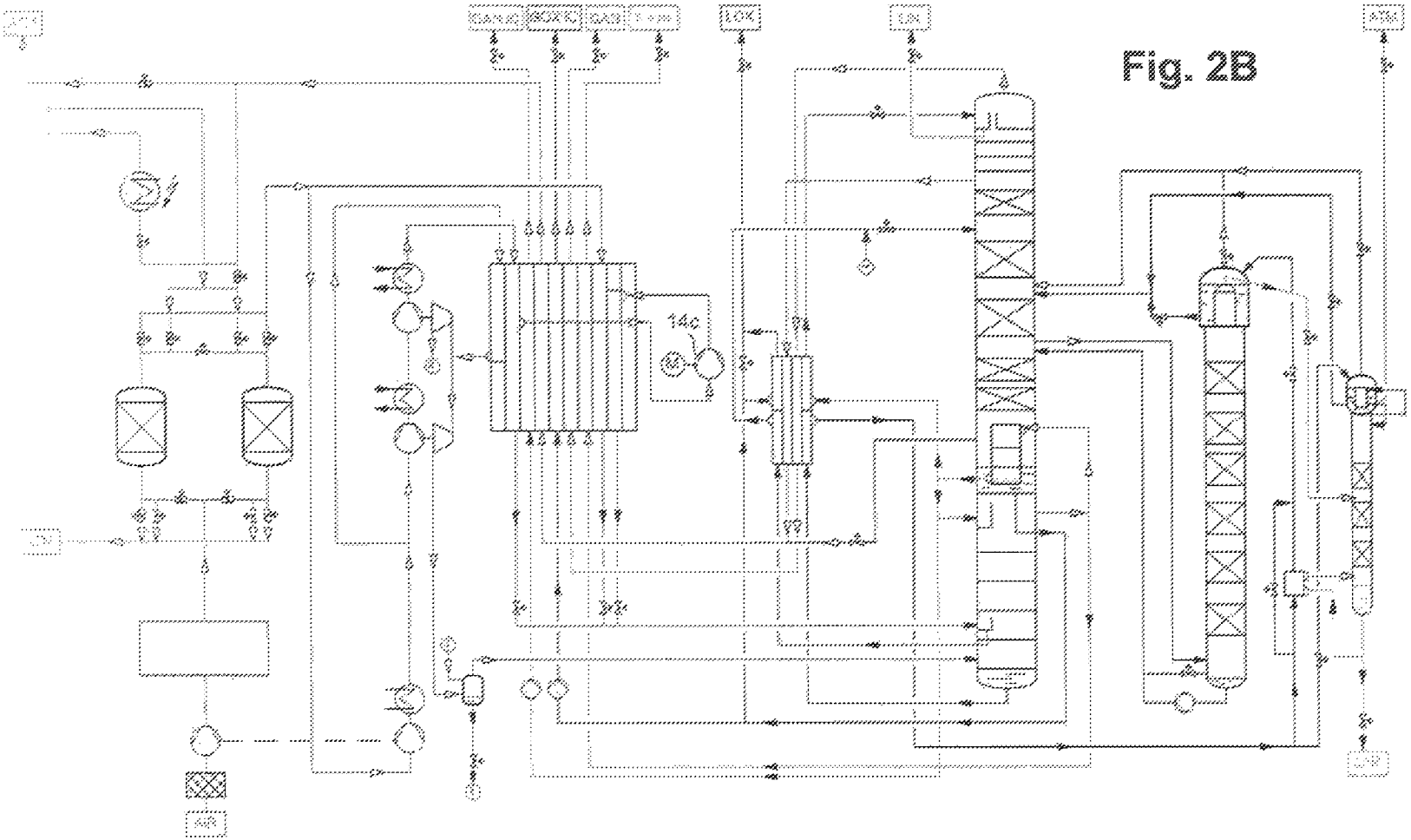

In FIG. 2B, the second turbine 14*t* is omitted. The cold compressor 14*c* is driven by an electric motor.

Figure 3:
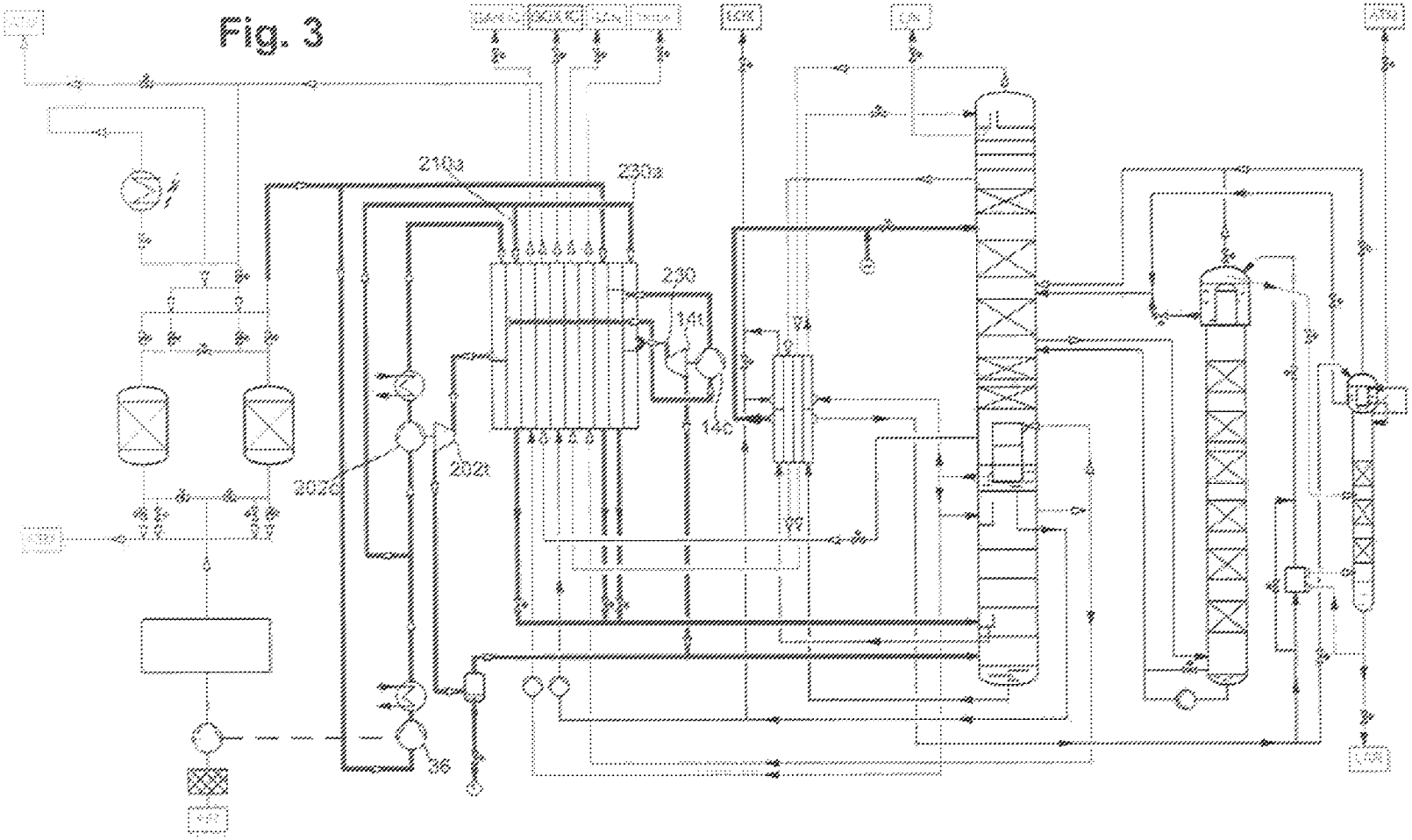
FIG. 3 shows a third exemplary embodiment in which the turbine-cold compressor combination is also flowed through in the first mode of operation.

In the exemplary embodiment of FIG. 3, the turbine-cold compressor combination is also not switched off in the maximum liquid operation, that is to say in the first mode of operation. FIG. 3 also differs from FIG. 1 by the following method features:

The fourth air flow 210*a*/220 is already branched off upstream of the first post-compressor 202*c* and is used as a relatively low-pressure throttle flow.

Equally, the air 230*a*/230 for the second turbine 14*t* (the third part of the second air flow) is already branched off upstream of the first post-compressor 202*c*.

Here, the pressure increase produced by the two turbine-driven post-compressors 202*c* and 14*c* is therefore used principally for increasing the pressure in the sixth air flow, which is used as a particularly high-pressure throttle flow. The first turbine 202*t* is operated at a higher inlet pressure than the second turbine 14*t*.

With the reduction in liquid production when transitioning from the first to the second operation case, the load on the second turbine 14*t* is increased and the load on the first turbine 202 is reduced.

Notwithstanding the representation in FIG. 3, the throttle flow 210*a* and the turbine flow 230*a* can also be branched off only after the turbine-driven hot post-compressor 202, as is represented in FIG. 1.

In all variants of the invention, the second turbine 14*t* can also be formed such that it injects not into the high-pressure column 10 but into the low-pressure column 12; by virtue of the correspondingly raised pressure ratio, more energy can be made available for the cold compressor.

Figure 3A:
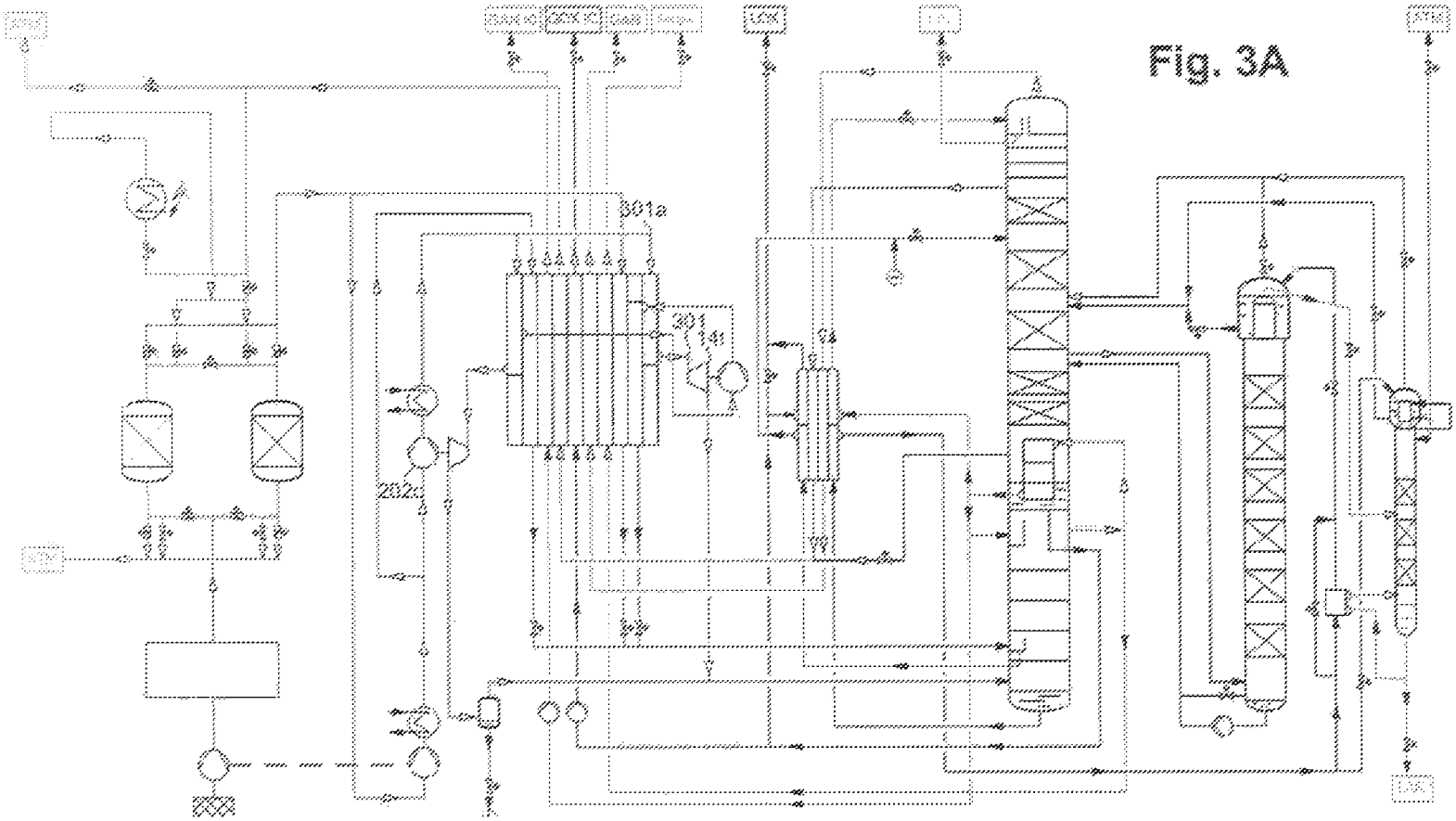
FIGS. 3A and 3B show two variants of FIG. 3.

FIG. 3A differs from FIG. 3 in that the fifth air flow 301 to the second turbine 14*t* is not at the first air pressure but at the third air pressure downstream of the hot post-compressor 202*c*. It is fed via the additional line 301*a* to the hot end of the main heat exchanger and further via line 301 to the turbine inlet.

Figure 3B:
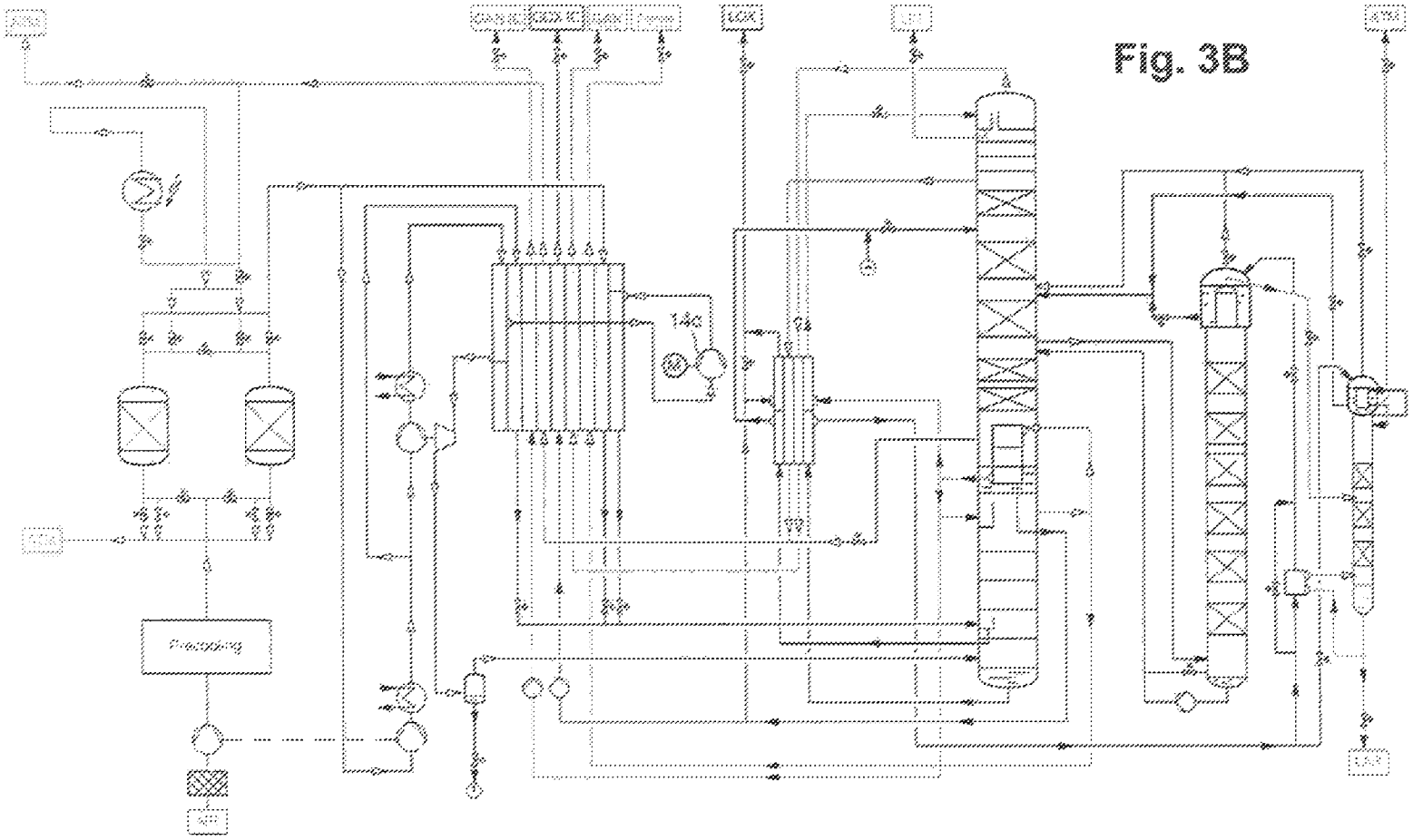

In FIG. 3B, the second turbine 14*t* is omitted. The cold compressor 14*c* is driven by an electric motor.

The effect of the invention can be further increased by connecting, downstream of the cold compressor 14*c*, a second cold compressor which can be switched off. This modification can be used in all exemplary embodiments, for example in those of FIGS. 3 and 3B. In the second mode of operation, the flow from the first cold compressor 14*c* is fed through a second cold compressor before it is fed back into the main heat exchanger. The second cold compressor is driven with an electric motor. In the first mode of operation, the second cold compressor is switched off and the flow from the first cold compressor 14*c* flows via a bypass line past the second cold compressor.

What I claim is:

1. A method for cryogenic separation of air in an air separation plant which has a main air compressor, a main heat exchanger and a distillation column system with a high-pressure column and a low-pressure column, said method comprising:

compressing feed air in the main air compressor to a first air pressure which is at least 3 bar higher than an operating pressure of the high-pressure column, in order to form a compressed feed air flow, splitting the compressed feed air flow into at least a first air flow and a second air flow, cooling and liquefying or pseudo-liquifying the first air flow at said first air pressure in the main heat exchanger, then expanding said first air flow and introducing said first air flow into the distillation column system, compressing the second air flow in an air post-compressor to a second air pressure which is higher than the first air pressure, to form a compressed second air flow, splitting the compressed second air flow into at least a third air flow and a fourth air flow, further compressing the compressed second air flow, before the compressed second air flow is split, or further compressing the third air flow or the fourth air flow in a post-compression system to a third air pressure which is higher than the second air pressure, wherein the post-compression system has at least one first turbine-driven post-compressor, introducing the third air flow at a first turbine inlet pressure into a first turbine, where the third air flow is expanded, performing work, and then introducing the third air flow into the distillation column system, wherein the first turbine drives the first turbine-driven post-compressor, cooling and liquefying or pseudo-liquifying the fourth air flow, in the main heat exchanger, then expanding said fourth air flow and introducing said fourth air flow into the distillation column system, withdrawing a first product stream from the distillation column system in liquid form, pressurizing the first product stream, in liquid form, to a first elevated product pressure, evaporating or pseudo-evaporating and further heating the first product stream at the first elevated product pressure in the main heat exchanger to form a first compressed gas product and withdrawing the first compressed gas product from the air separation plant, cooling a sixth air flow in the main heat exchanger to a first intermediate temperature, and compressing the sixth air flow in a cold compressor to a fourth air pressure which is higher than the third air pressure, and cooling and liquefying or pseudo-liquifying the sixth air flow at the fourth air pressure in the main heat exchanger, then expanding the sixth air flow and introducing the sixth air flow into the distillation column system, wherein said method has at least a first mode of operation and a second mode of operation, and in both said first mode of operation and said second mode of operation at least one liquid product is produced in the distillation column system and withdrawn in liquid form from the air separation plant, in the first mode of operation the at least one liquid product is withdrawn from the air separation plant in a first amount, in the second mode of operation the at least one liquid product is withdrawn in a second amount, wherein the second amount of the at least one liquid product is 15 to 50% of the first amount of the at least one liquid product, and in the first mode of operation a first amount of the sixth air flow flows through the cold compressor, in the second mode of operation a second amount of the sixth air flow flows through the cold compressor, and the first amount of the sixth air flow is less than the second amount of the sixth air flow.

2. The method according to claim 1, wherein a fifth air flow at the first air pressure is introduced into a second turbine where the fifth air flow is expanded, performing work, wherein the second turbine drives the cold compressor, and the fifth air flow is then introduced into the distillation column system, and wherein in the first mode of operation a first amount of the fifth air flow flows through the second turbine, in the second mode of operation a second amount of the fifth air flow flows through the second turbine, and the first amount of the fifth air flow is less than in the second amount of the fifth air flow.

3. The method according to claim 1, wherein the third air flow is introduced into the first turbine at the third air pressure.

4. The method according to claim 1, wherein the third air flow is expanded in the first turbine to an outlet pressure which is equal to the operating pressure of the high-pressure column.

5. The method according to claim 2, wherein the fifth air flow is expanded in the second turbine to an outlet pressure which is equal to the operating pressure of the high-pressure column.

6. The method according to claim 2, wherein, in the second mode of operation, the fifth air flow is expanded in the second turbine to an outlet pressure which is equal to an operating pressure of the low-pressure column.

7. The method according to claim 1, wherein in both the first and second modes of operation, after expansion, at least one part of at least one of the following air flows is introduced into the high-pressure column: the first air flow, the third air flow, and/or the fourth air flow.

8. The method according to claim 2, wherein, after expansion, at least one part of the fifth air flow is introduced into the high-pressure column.

9. The method according to claim 1, wherein the main air compressor and the air post-compressor are formed by a combined machine with common drive wherein the main compressor is a first set of stages of the combined machine and the air post-compressor is a second set of stages of the combined machine.

10. The method according to claim 1, wherein in the first mode of operation the fourth air flow is introduced into the distillation column system in a first amount and in the second mode of operation the fourth air flow is introduced into the distillation column system in a second amount, and wherein the second amount of the fourth air flow is less than the first amount.

11. The method according to claim 1, wherein, the second mode of operation, the compressed second air flow is split into the third air flow, the fourth air flow, and a seventh air flow, and wherein the seventh air flow is expanded, performing work, in a third turbine and is then introduced into the distillation column system.

12. The method according to claim 11, wherein, in the first mode of operation, the third turbine drives a third turbine-driven post-compressor which is part of the post-compression system.

13. The method according to claim 1, further comprising withdrawing a second product stream flow in liquid form from the distillation column system, pressurizing the second product stream in liquid form to a second elevated product pressure, evaporating or pseudo-evaporating and further heating the second product stream in the main heat exchanger, and then withdrawing the second product stream from the air separation plant, wherein first product stream is withdrawn from a lower region of the low-pressure column, and/or wherein the second product stream is withdrawn from an upper region of the high-pressure column or from a top condenser of the high-pressure column.

14. An air separation plant for cryogenic separation of air comprising:

a main heat exchanger, a distillation column system having a high-pressure column and a low-pressure column, a main air compressor for compressing a feed air to form compressed feed air at a first air pressure which is at least 3 bar higher than an operating pressure of the high-pressure column, at least one first passage within said main heat exchanger for cooling a first part of the compressed feed air at the first air pressure in the main heat exchanger, an expansion device for expanding the first part of the compressed feed air, after passage through the main heat exchanger, and a first line for removing the first part of the compressed feed air from the expansion device and introducing the first part of the compressed feed air into the distillation column system, an air post-compressor for post-compressing a second part of the compressed feed air to a second air pressure, a post-compression system for further compressing at least a first part of the second part of the compressed feed air to a third air pressure which is higher than the second air pressure, wherein the post-compression system has at least one first turbine-driven post-compressor, a first turbine for work-performing expansion of a third air flow from a first turbine inlet pressure, wherein the first turbine is coupled to the first turbine-driven post-compressor, at least one second passage within said main heat exchanger for cooling a fourth air flow in the main heat exchanger, an expansion device for expanding cooled fourth air flow and a second line for introducing expanded fourth air flow into the distillation column system, first pipeline means for withdrawing at least one liquid product from the distillation column system, means for pressurizing at least one liquid product in liquid form to a first elevated product pressure, at least one third passage within said main heat exchanger for heating the at least one liquid product at the first elevated pressure in the main heat exchanger, and second pipeline means for withdrawing heated first product flow from the air separation plant to form a first compressed gas product, at least one fourth passage within said main heat exchanger for cooling a sixth air flow in the main heat exchanger to a first intermediate temperature, a cold compressor for further compressing the sixth air flow to a fourth air pressure which is higher than the third air pressure, at least one fifth passage within said main heat exchanger for cooling compressed sixth air flow at the fourth air pressure in the main heat exchanger, an expansion device for expanding the sixth air flow and a third line for introducing the cooled sixth air flow into the distillation column system, and at least one liquid product pipeline for withdrawing the at least one liquid product from the air separation plant, wherein in a first mode of operation a first amount of the at least one liquid product is withdrawn via said at least one liquid product pipeline and in a second mode of operation a second amount of the at least one liquid product is withdrawn via said at least one liquid product pipeline, and wherein the second amount of at least one liquid product is 15 to 50% of the first amount of at least one liquid product, and in the first mode of operation a first amount of the sixth air flow flows through the cold compressor and in the second mode of operation a second amount of the sixth air flow flows through the cold compressor, wherein the first amount of the sixth flow is less than the second amount of the sixth flow.

15. A method for cryogenic separation of air in an air separation plant which has a main air compressor, a main heat exchanger and a distillation column system with a high-pressure column and a low-pressure column, said method comprising:

compressing feed air in the main air compressor to a first air pressure which is at least 3 bar higher than an operating pressure of the high-pressure column, in order to form a compressed feed air flow, splitting the compressed feed air flow into at least a first air flow and a second air flow, cooling and liquefying or pseudo-liquifying the first air flow at said first air pressure in the main heat exchanger, then expanding said first air flow and introducing said first air flow into the distillation column system, compressing the second air flow in an air post-compressor to a second air pressure, which is higher than the first air pressure, to form a compressed second air flow, splitting the compressed second air flow into at least a third air flow and a fourth air flow, further compressing the compressed second air flow, before the compressed second air flow is split, or further compressing the third air flow or the fourth air flow in a post-compression system to a third air pressure which is higher than the second air pressure, wherein the post-compression system has at least one first turbine-driven post-compressor, introducing the third air flow at a first turbine inlet pressure into a first turbine, where the third air flow is expanded, performing work, and then introducing the third air flow into the distillation column system, wherein the first turbine drives the first turbine-driven post-compressor, cooling and liquefying or pseudo-liquifying the fourth air flow, in the main heat exchanger, then expanding said fourth air flow and introducing said fourth air flow into the distillation column system, withdrawing a first product stream from the distillation column system in liquid form, pressurizing the first product stream, in liquid form, to a first elevated product pressure, evaporating or pseudo-evaporating and further heating the first product stream at the first elevated product pressure in the main heat exchanger to form a first compressed gas product and withdrawing the first compressed gas product from the air separation plant, cooling a sixth air flow in the main heat exchanger to a first intermediate temperature, and compressing the sixth air flow in a cold compressor to a fourth air pressure which is higher than the third air pressure, and cooling and liquefying or pseudo-liquifying the sixth air flow at the fourth air pressure in the main heat exchanger, then expanding the sixth air flow and introducing the sixth air flow into the distillation column system, wherein said method has at least a first mode of operation and a second mode of operation, and in both said first mode of operation and said second mode of operation at least one liquid product is produced in the distillation column system and withdrawn in liquid form from the air separation plant, in the first mode of operation the at least one liquid product is withdrawn from the air separation plant in a first amount, in the second mode of operation the at least one liquid product is not withdrawn or is withdrawn in a second amount, wherein the second amount of the at least one liquid product is less than the first amount of the at least one liquid product, and in the first mode of operation a first amount of the sixth air flow flows through the cold compressor, in the second mode of operation a second amount of the sixth air flow flows through the cold compressor, and the first amount of the sixth air flow is less than the second amount of the sixth air flow.

* * * * *